United States Patent [19]

Brinker

[11] Patent Number: 4,915,402

[45] Date of Patent: Apr. 10, 1990

[54] LUGGAGE WITH RETRACTABLE WHEEL SYSTEM

[75] Inventor: Barry Brinker, Cincinnati, Ohio

[73] Assignee: 'totes', incorporated, Loveland, Ohio

[21] Appl. No.: 260,189

[22] Filed: Oct. 19, 1988

[51] Int. Cl.[4] ..... B62B 1/12

[52] U.S. Cl. ..... 280/37; 280/43.1; 280/47.26; 16/29; 190/18 A

[58] Field of Search ..... 280/43.1, 37, 43, 43.17, 280/47.131, 43.26, 638, 639; 190/18 A, 18 R; 16/29–34

[56] References Cited

U.S. PATENT DOCUMENTS

| | | | |
|---|---|---|---|
| Re. 17,720 | 7/1930 | Whearg | 190/18 |
| 1,895,677 | 1/1933 | Pinheiro | 190/18 A |
| 2,002,836 | 5/1935 | Rossi | 280/645 |
| 2,439,660 | 4/1948 | Keil | 280/37 |
| 2,919,138 | 12/1959 | Brower et al. | 280/35 |
| 3,014,733 | 12/1961 | Higginbotham | 280/43.1 |
| 4,026,569 | 5/1977 | Staal | 280/43 |
| 4,097,955 | 7/1978 | Foge et al. | 16/29 |
| 4,217,675 | 8/1980 | Haft | 16/19 |
| 4,273,222 | 6/1981 | Lassimally et al. | 190/18 A |
| 4,397,062 | 8/1983 | Huang | 16/33 |
| 4,575,109 | 3/1986 | Loudery | 280/37 |
| 4,773,123 | 9/1988 | Yu | 280/37 |

*Primary Examiner*—Charles A. Marmor

*Assistant Examiner*—Richard Camby

*Attorney, Agent, or Firm*—Wood, Herron & Evans

[57] ABSTRACT

A case having at least one wheel mounted adjacent the case's floor, that wheel being retractable interiorly of the case into a storage position and extendable exteriorly of the case below the floor where the case can roll on the wheel. One feature is that a retract operator connected to the wheel is manually movable in one of generally parallel and normal directions relative to the floor in order to retract the wheel into the storage position, and a separate extend operator also connected to the wheel is manually movable in the other of the generally parallel and normally directions relative to the floor in order to extend the wheel into the use position. Another feature is that a single spring motor is connected with both the retract and extend operator in order to continually bias both those operators toward one of each operator's first and second operational positions. A third feature includes a pivotable drum to which the wheel is connected by a crank arm, the drum moving the wheel between storage and use positions in response to the operators and a drum spring motor, and a latch cooperable with the drum to hold it in that position to which the drum is not continually spring biased, that latch being continuously being biased toward the latching position by that same spring motor.

12 Claims, 2 Drawing Sheets

LUGGAGE WITH RETRACTABLE WHEEL SYSTEM

This invention relates to containers. More particularly, this invention relates to a container preferably in the form of a case that includes a wheel retractable interiorly and extendable exteriorly relative to the case's floor.

Luggage, in the form of suitcases or the like, with wheels or rollers on the outside or underside of the luggage floor is well known. These wheels allow the user to simply roll the suitcase along a sidewalk or hallway instead of carrying it by the handle. Such a suitcase wheel system is particularly useful with large suitcases that are fully and heavily packed. And such a wheel system is particularly useful when a traveler is making use of airplane terminals or the like which require long walking distances without the possibility of motorized transport for the traveler or the luggage. Therefor, a significant commercial market has developed for luggage which permits the user or traveler to simply roll the suitcase or the like as desired from one location to another.

There is one significant disadvantage to prior art wheeled luggage. The wheels extend beneath the suitcase's floor, and therefor the wheels take up additional space when it is desired to store the suitcase in, for example, the overhead compartment of an airplane or the trunk of a car. Also the wheels, which are mounted below the suitcase's floor, are always readily visible to others which may be aesthetically undesirable in certain situations, and they may tend to catch on the user's clothing or otherwise provide a handicap when the suitcase is being manually carried. Now it is known to the prior art to provide luggage with retractable wheels. But no luggage manufacturer, as far as applicant is aware, has ever seen commercial success with luggage that makes use of a retractable wheel system.

Accordingly, it has been the objective to this invention to provide a container, in preferred form an item of luggage, with a retractable wheel system that is relatively easy for the user to operate, that is relatively fail safe in operation, that provides a relatively long useful life, and that is relatively simply to manufacture. In accord with this objective, the retractable wheel system of this invention includes a case having at least one wheel mounted adjacent the case's floor, that wheel being retractable interiorly of the case into a storage position and extendable exteriorly of the case below the floor where the case can roll on the wheel. One feature is that a retract operator connected to the wheel is manually movable in one of generally parallel and normal directions relative to the floor in order to retract the wheel into the storage position, and a separate extend operator also connected to the wheel is manually movable in the other of the generally parallel and normal directions relative to the floor in order to extend the wheel into the use position. Another feature is that a single spring motor is connected with both the retract and extend operators in order to continually bias both those operators toward one of each operator's first and second operational positions. A third feature includes a pivotable drum to which the wheel is connected by a crank arm, the drum moving the wheel between storage and use positions in response to the operators and a drum spring motor, and a latch cooperable with the drum to hold it in that position to which the drum is not continually spring biased, that latch being continuously being biased toward the latching position by that same spring motor.

Other objectives and advantages of this invention will be more apparent from the following detailed description taken in conjunction with the drawings in which.

Figure 1:
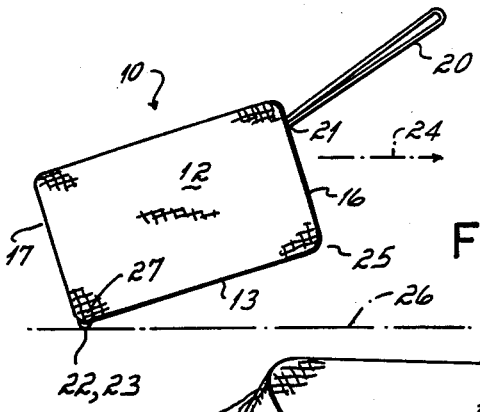
FIG. 1 is a side elevational view of a suitcase with retractable wheel system in accord with the principles of this invention.

A suitcase 10 with retractable wheel system 11 in accord with the principles of this invention is illustrated in FIG. 1. The suitcase basically includes a case 12 with a floor 13, side walls 14, top wall 15, and front 16 and rear 17 end walls. A zipper 18 is provided in the case's top 15, front 16 and rear 17 end walls to provide access into the case's interior, and a carrying strap 19 by which the case can be carried. The retractable wheel system 11 is in the form of a module, and is installed inside the case at the corner of the rear wall 17 and floor 13. A leash 20 is tethered as at 21 to the case's front wall 16 adjacent the case's top wall 15. In use, and since wheels 22, 23 are provided only at the rear edge of the case's floor 13, when the case 12 is drawn in the direction shown by phantom arrow 24 by pulling on the tether 20, the case's bottom front corner 25 raises up above ground 26 so that the case 12 rolls only on the wheels 22, 23 at the bottom rear corner 27. With this tether 20 arrangement, the case 12 need only be provided with a single pair of wheels 22, 23 in order for the luggage to be easily drawn over ground 26 by the user.

Figure 2:
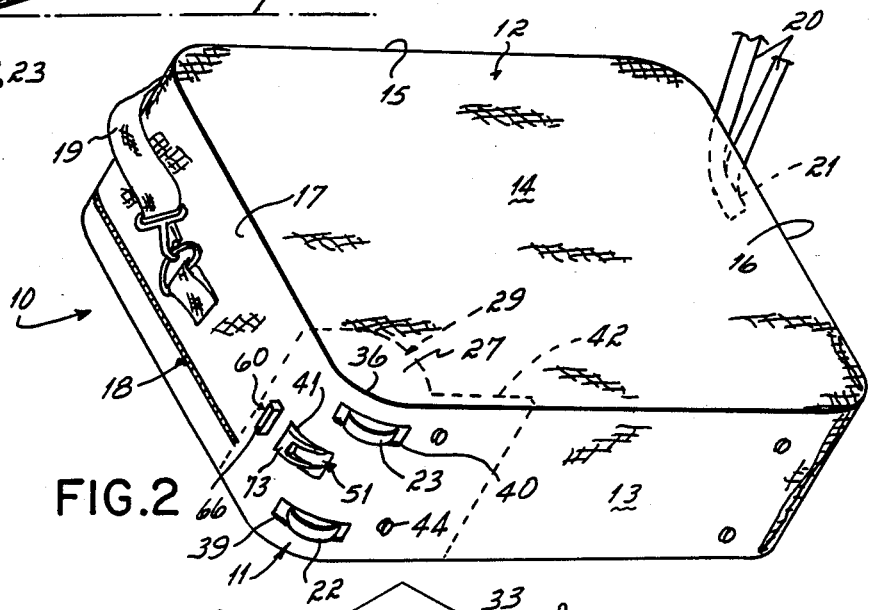
FIG. 2 is a bottom perspective view of the retractable wheel system on the suitcase shown in FIG. 1, the wheels being illustrated in the extended or use position.
Figure 3:
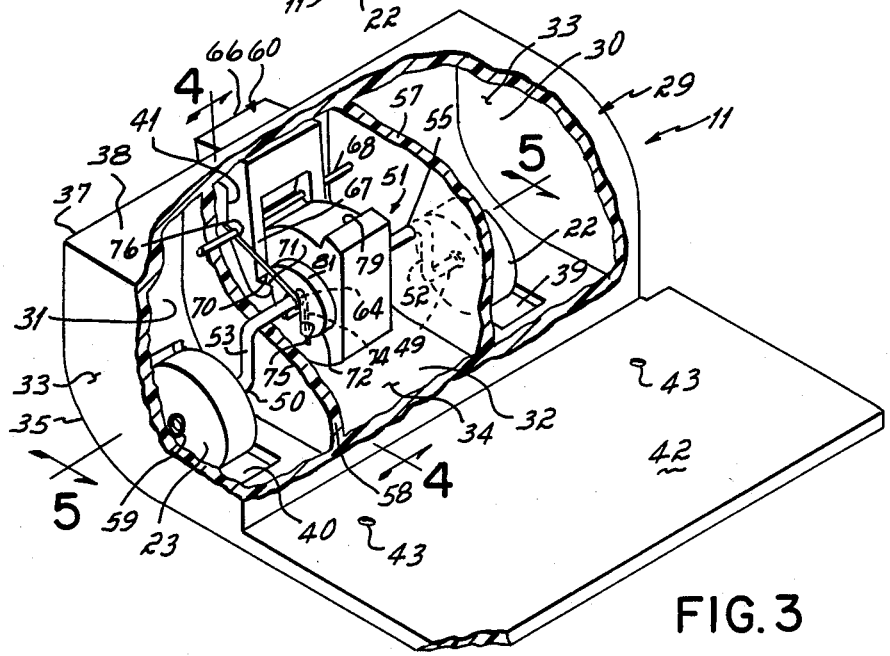
FIG. 3 is a partially broken away top perspective view of a retractable wheel system module removed from the suitcase, the wheels being shown in the extended or use position.

The retractable wheel system 11, as shown in FIGS. 2 and 3, includes a modular housing 29 with wheel chambers 30, 31 on each end thereof, those wheel chambers being separated by an operator unit chamber 32 centrally located thereof, relative to the side walls 33 of that housing. The housing's bottom wall 34 is curved as at 35 to fit with the curved bottom rear edge 36 of the case 12 at the corner 27 of the case's rear wall 17 and floor 13 as shown particularly in FIG. 2. The wheel 30, 31 and operator unit 32 chambers are enclosed by the housing's end wall 37, and by a top wall 38. The bottom wall 34 and end wall 37 are provided with wheel ports 39, 40 and operator access port 41 for purposes explained below. The top wall 38 prevents any items being carried within the case's interior from interfering with the retractable wheel system 11. The modular housing's bottom wall also includes a mount plate 42 that extends from the chamber 30-32 section so as to permit interconnection of the modular housing 29, and therefor the retractable wheel system 11, with the case's floor 13 as through connector holes 43 and connectors 44 (FIG. 2).

The retractable wheel system 11 includes two wheels 22, 23, both being simultaneously extendable (see FIGS. 3 and 4) exteriorly of the case 12 below the floor 13 into the use position where the case can roll on the wheels, and both being simultaneously retractable (see FIGS. 7 and 8) interiorly of the case into a storage position so the case cannot roll on the wheels. These wheels 22, 23 are mounted on a common wheel axis 48 defined by spaced axles 49, 50. The spaced axles 49, 50 are connected with one another through a drum 51 and right angle mirror image crank arms 52, 53. The drum 51 and crank arms 52, 53 define a crank axis 54 which is substantially spaced from, but parallel to, the wheel axis 48. Each crank arm 52, 53 is integral with a wheel axle 49, 50, and each crank arm is carried in a bearing 55, 56 which is defined by a bearing wall 57, 58 of the modular housing 29. The wheels 22, 23 are rotatable relative to the wheel axles 49, 50 by virtue of bearing sleeves 59, and the crank arms 52, 53 are pivotable relative to the crank axis 54 by virtue of being pivotally mounted in the bearing walls 57, 58. Accordingly, when the crank arms 52, 53 are pivoted from that position illustrated in FIGS. 3 and 4 to that position illustrated in FIGS. 7 and 8, the wheels 22, 23 are retracted interiorly into the wheel chambers 30, 31 into the storage position, and when the opposite occurrence transpires the wheels are extended exteriorly of the wheel chambers into the use position.

A retract operator 60 and an extend operator 61 are both connected with the wheels 22, 23 through the positioner drum 51. The retract operator 60 is manually movable in a generally parallel direction (see phantom arrow 60*a*) relative to the case's floor 13 and toward the case's interior in order to cause the wheels to retract into the storage position. The extend operator 61 is manually movable in a direction (see phantom arrow 61*a*) generally normal to and away from to the case's floor 13 in order to cause the wheels to extend into the use position. A spring motor that includes coil spring 64 and leaf spring 65 is interconnected with the retract operator 60 and the extend operator 61. The coil spring 64 is interconnected with the extend operator 61, and the drum 51 in order to continuously bias the wheels 22, 23 to their storage position, and the leaf spring 65 connected with that coil spring 64 is also connected with the retract operator 60 to continuously bias the retract operator toward latching relationship with the drum.

Figure 5:
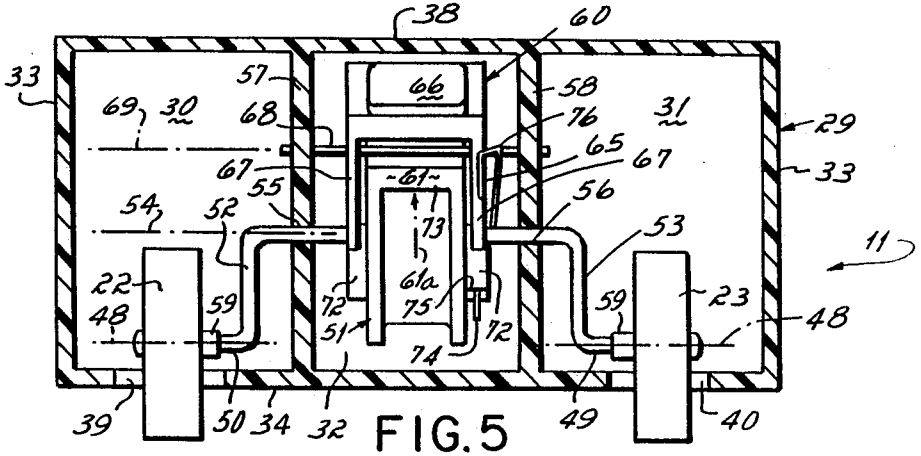
FIG. 5 is a cross-sectional view taken along line 5—5 of FIG. 3.
Figure 4:
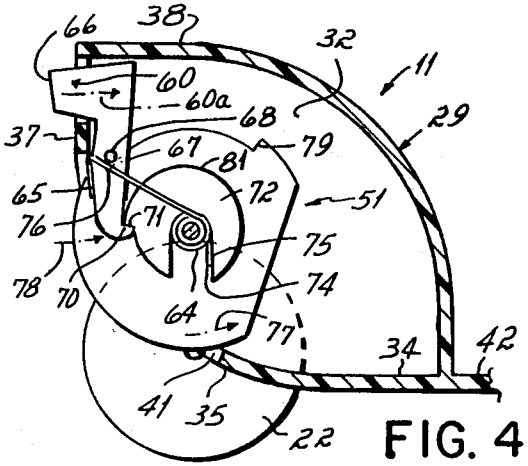
FIG. 4 is a cross-sectional view taken along line 4—4 of FIG. 3.

More specifically, and as illustrated in FIGS. 3–5, the retract operator 60 includes a pushbutton 66 which is manually accessible exteriorly of the case. The pushbutton 66 is formed integral with a latch lever 67 pivotally mounted on latch pin 68. The latch pin 68 is pivotally carried in the modular housing's bearing walls 57, 58, and defines a pivot axis 69 for the latch lever 67 which is parallel to the crank axis 54 and the wheel axis 48, all of which are parallel to the case's floor 13. The latch lever 67 includes a latch dog 70 at that end opposite the pushbutton 66 end, the latch dog cooperating with latch seat 71 on the drum 54 to provide a latch assembly which retains the drum, and therefor the wheels 22 and 23 in the extended position. In other words, the drum 54 is held in the extended position by virtue of inter-engagement of the latch seat 71 formed in hub 72 fixed to the drum with the retract operator's latch dog 70 as particularly shown in FIGS. 3 and 4.

The extend operator 61 is in the form of a pushbutton 73 defined as a ledge on the outer surface of the drum 54 and, therefor, integral with that drum, as illustrated in FIG. 5. The coil spring 64 is in the form of a torsion spring axially received around crank axis arm 54. End 74 of the torsion spring bears against ledge 75 defined by the drum's hub 72, and end 76 of the torsion spring bears against latch pin 68 that is in fixed position relative to the housing 29. With the torsion coil spring 64 oriented as shown in FIG. 3, the drum 54 is continuously spring biased in the direction shown by phantom arrow 77. The spring motor also includes the leaf spring 65 connected to the end 76 of the torsion coil spring 64. The leaf spring 65 is positioned, as shown in FIG. 4, to bear against the latch lever 67 in such a manner as to continuously spring bias the latch lever in the pivot direction shown by phantom arrow 78. In order to hold the wheels 22, 23 in the extended position, the drum 54 is rotated in a direction opposite to its normal spring biased direction 77 until latch dog 70 seats in the drum hub's latch seat 71 to hold the wheels in the extended position. The wheels 22, 23 are located in the retracted position, when the latch dog 70 is disengaged from the drum hub's latch seat 71, by stop ledge 79 formed on the drum's outer periphery inter-engaging the latch lever's pivot pin 68 as shown in FIG. 8.

Figure 7:
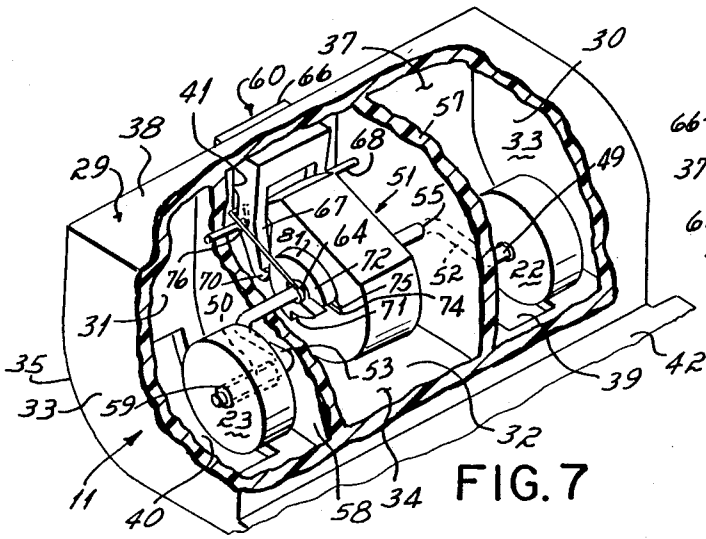
FIG. 7 is a view similar to FIG. 3 but with the wheels in the retracted position.
Figure 6:
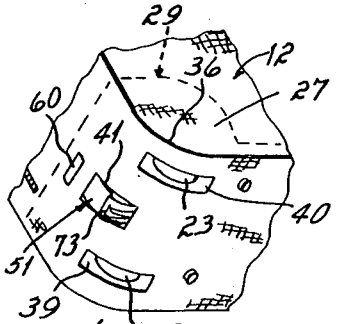
FIG. 6 is a view similar to FIG. 2 but with the wheels in the retracted position.

In use, the drum 51 is unlatched in the wheel 22, 23 retracted or storage position and the drum is latched in the wheel extended or use position. In the retracted position, and as shown in FIGS. 7 and 8, the torsion coil spring 64 biases the drum 51 into the retracted position until the wheels 22, 23 are located interiorly of the wheel chambers 30, 31. This interior storage position is defined by the drum's stop ledge 79 inter-engaging the latch lever's pivot pin 68. And this interior storage position of the wheels 22, 23 within the wheel chambers 30, 31 is accomplished by pushing the retract operator 60 in a direction parallel to the case's floor 13 toward the case's interior as shown by phantom arrow 60*a*. When the pushbutton is pushed in that phantom arrow direction 60*a*, the latch dog 70 is disengaged from latching relation with the drum hub's seat 71 and this permits the coil spring 64 to bias the drum 51 in a counterclockwise direction as shown by phantom arrow 77 which, in turn, allows the crank arms 52, 53 to retract the wheels 22, 23 interiorly of the wheel's chambers. In this retracted position, and as shown in FIG. 8 particularly, the latch assembly's latch dog 70 rides on the hub's peripheral surface 81, and is continually biased toward that peripheral surface by leaf spring 65. So when the retract operator's button 66 is pushed in the direction shown by phantom arrow 60*a*, the latch finger's latch dog 70 is released from the drum hub's latch seat 71, and the torsion coil spring 64 retracts the wheels 22, 23 automatically into the modular housing's wheel chambers 30, 31. The latch assembly's latch dog 70, thereafter remains constantly ready to re-seat into the drum hub's latch seat 71 because it is continually spring-biased against the drum hub's periphery 81 by the leaf spring 65.

Figure 8:
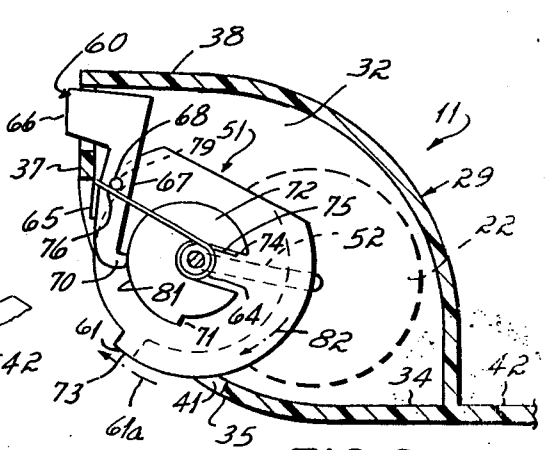
FIG. 8 is a view similar to FIG. 4 but with the wheels in the retracted position.

In order to extend the wheels 22, 23 from the storage position shown in FIG. 8 to the use position shown in FIG. 4, the extend operator's pushbutton 73 is pushed in a generally vertical direction as shown by phantom arrow 61*a* away from the case's floor 13. This manual force exerted against the pushbutton 73, since it is integral with the drum 51, causes the drum to pivot in the clockwise direction 82 against the coil spring 64 bias.

This, in turn causes the crank arms 52, 53 to extend the wheels 22, 23 into the use position shown in FIGS. 3–5. As the drum 51 is rotated in the clockwise direction by virtue of manual force against the pushbutton 73 direction as shown by phantom arrow 61*a*, the torsion coil spring 64 is wound up by virtue of its ends 74, 76 being trapped against the drum hub 72 at seat 75 on the one end and against the latch assembly's pivot pin 68 on the other end. The wheels 22, 23 are in the full extended position, and are held in that full extended position against the retract bias continuously exerted on the drum 51 by the torsion coil spring 64, when the latch assembly's latch dog 70 seats into the drum hub's latch seat 71. Since the latch assembly's latch dog 70 is continuously biased against the drum hub's periphery 81 by leaf spring 65 connected with the latch lever 67, the latch dog will automatically drop into the drum hub's seat when the wheels are fully extended into the desired use position. So when the extend operator's pushbutton 73 is pushed in the direction shown by phantom arrow 61*a*, the wheels 22, 23 are extended against the torsion spring 64 bias into the use position. Note particularly that a single spring, which is made up of a torsion spring 64 component and a leaf spring component 65, provides two functions. Specifically, the torsion spring 64 retracts the wheels 22, 23, i.e., continuously biases the wheels to the storage position, and the leaf spring 65 component, which is in effect a latch spring, continuously biases the latch finger 67 to a latch position with the rum hub 45.

Having described in detail the preferred embodiment of my invention, what I desire to claim and protect by Letters Patent is:

1. A container comprising a case with a floor, at least one wheel mounted to said case adjacent said floor, said wheel being retractable interiorly of said case into a storage position and extendable exteriorly of said case into a use position where said case can roll on said wheel, and said wheel being continually biased to the storage position a retract operator operably connected to said wheel, said retract operator being manually movable in one of generally parallel and normal directions relative to said floor in order to cause said wheel to retract into said storage position, an extend operator operably connected to said wheel, said extend operator being manually movable in the other of said generally parallel and normal directions relative to said floor in order to cause said wheel to extend into said use position, both of said retract and extend operators being manually accessible and operable from exteriorly of said case, a wheel mount assembly connected to said case, said wheel mount assembly being operable to retract and extend said wheel between storage and use positions, said assembly comprising a drum and a crank arm connected to said drum, said crank arm also being connected to said wheel, pivotable motion of said drum relative to the drum's axis causing said wheel to move between wheel storage and use positions, a drum motor connected with said drum, said drum motor operating to continually bias said drum to one of the wheel storage and use positions, and a stop having one component partially carried on said drum and having another component partially carried by said latch assembly, said stop components cooperating to locate said drum in that position to which it is biased by said drum motor, and a latch assembly connected to said case, said latch assembly being operable to latch said wheel mount assembly in an attitude where said wheel is located in one of its storage and use positions, said latch assembly comprising a latch cooperable with said drum to hold said drum in that one of wheel storage and use positions to which said drum is not continually biased, and a latch motor connected with said latch, said latch motor continually biasing said latch to that position at which it will cooperate with said drum to hold said drum in that position to which said drum is not continually biased whenever said drum is moved into that position.

2. A container as set forth in claim 1, said retract operator being movable generally parallel to said floor and said extend operator being movable generally normal to said floor.

3. A container as set forth in claim 1 comprising a modular housing fixed to said case, said wheel, retract operator and extend operator all being carried by said housing.

4. A container comprising a case having a floor, at least one wheel mounted to said case adjacent said floor, said wheel being retractable interiorly of said case into a storage position and extendable exteriorly of said case into a use position where said case can roll on said wheel, a retract operator connected to said wheel, said retract operator being movable between a first position at which said wheel is in the use position and a second position at which said wheel is in the storage position, an extend operator connected to said wheel, said extend operator being movable between a first position at which said wheel is in the use position and a second position at which said wheel is in the storage position, a spring motor connected with both said retract and extend operators, said spring motor operating to continually bias both said retract and extend operators toward one of the first and second operational positions for each operator, a drum connected to said spring motor, said drum including a crank arm connected to said wheel, pivotable motion of said drum relative to the drum's axis causing said wheel to move between storage and use positions, one of said retract and extend operators being mounted on said drum, said spring motor simultaneously and continually biasing said drum and that one of said operators mounted thereon in one direction relative to the drum's axis, and a latch cooperatively connectable with said drum to hold said drum in that one of wheel storage and wheel use positions to which said drum is not continually biased, the other of said retract and extend operators being mounted on said latch, said spring motor simultaneously and continually biasing said latch to that position at which it will cooperate with said drum to hold said drum in that position to which said drum is not continually biased whenever said drum is moved into that position, said spring motor comprising a coil spring component operably connected with said drum, and a leaf spring component operably connected with said latch.

5. A container as set forth in claim 4 comprising a first stop component operably connected with said drum, and a second stop component operably connected with said latch, said stop components cooperating to locate said drum in that position to which it is biased by said drum motor.

6. A container as set forth in claim 4, said latch comprising a latch lever pivotally connected to said case on a pivot pin, one end of said coil spring component bearing against said drum and the other end bearing against said pivot pin, said leaf spring component extending from that end of said coil spring component bearing against said pivot pin.

7. A container comprising a case with a floor two wheels each mounted on an axle adjacent said floor, said wheels being spaced one from the other but located on a common wheel axis, said wheels being retractable interiorly of said case into storage position and extendable exteriorly of said case into use position where said case can be rolled on said floor, a drum mounted to said case, said drum being pivotable on a drum axis parallel to but spaced from said common wheel axis, a crank arm connected to each axle and to said drum, each crank arm being oriented at a generally right angle relative to said drum and wheel axes, pivotable motion of said drum relative to the drum's axis causing both said wheels to move simultaneously between storage and use positions, a drum motor connected with said drum, said drum motor operating to continually bias said drum to one of the wheel storage and use positions, a latch mounted to said case, said latch being cooperable with said drum to hold said drum in that one of wheel storage and use positions to which said drum is not continually biased, and a latch motor connected with said latch, said latch motor operating to continually bias said latch to that position at which it will operate with said drum to hold said drum in that latch position to which said drum is not continually biased whenever said drum is moved into that position.

8. A container as set forth in claim 7 comprising a first stop component operably connected with said drum, and a second stop component operably connected with said latch, said stop components cooperating to locate said drum in that position to which it is biased by said drum motor.

9. A container as set forth in claim 7, said latch comprising a latch lever pivotally connected on a pivot pin to said case, and a latch dog connected to said latch lever, said latch dog cooperating with said drum in its latch position.

10. A container as set forth in claim 9, the rotation axis of said wheel, the pivot axis of said drum, and the pivot axis of said latch lever all being parallel one to the other.

11. A container as set forth in claim 10, said drum comprising a stop mounted on the exterior surface of said drum, said stop being positioned to engage said latch lever's pivot pin to locate said drum in that position to which it is biased by said drum motor, and a latch seat mounted on said drum's exterior surface, said latch seat being positioned to engage said latch dog to hold said drum in its latch position.

12. A container as set forth in claim 10, said latch motor comprising a coil spring connected to said drum for continuously biasing said wheel to its storage position.

* * * * *

UNITED STATES PATENT AND TRADEMARK OFFICE

CERTIFICATE OF CORRECTION

PATENT NO. : 4,915,402

DATED : April 10, 1990

INVENTOR(S) : Barry Brinker

It is certified that error appears in the above-identified patent and that said Letters Patent is hereby corrected as shown below:

Title page:

In the Abstract - at Line 11 "normally" should be --normal--

In the Abstract - at Line 14 "operator" should be --operators--

At Column 5, Line 30 "rum" should be --drum--

Signed and Sealed this

First Day of October, 1991

*Attest:*

*Attesting Officer*

HARRY F. MANBECK, JR.

*Commissioner of Patents and Trademarks*